US005732529A

United States Patent [19]

Dey et al.

[11] Patent Number: 5,732,529

[45] Date of Patent: Mar. 31, 1998

[54] APPARATUS FOR FEEDING FOIL STOCK IN A PROCESS FOR MAKING SEALED STERILE PACKAGES

[75] Inventors: Clifford A. Dey, San Angelo, Tex.; Robert J. Cerwin, Pipersville, Pa.; J. Mark Findlay, San Angelo, Tex.; Konstantin K. Ivanov, Bound Brook, N.J.; Robert Nuñez, Asbury, N.J.; Donald Pompei, Montville, N.J.; William R. Reinhardt, Belle Mead, N.J.; Mehmet Reyhan, E. Windsor, N.J.; David A. Szabo, Branchburg, N.J.

[73] Assignee: Ethicon, Inc., Summerville, N.J.

[21] Appl. No.: 624,926

[22] Filed: Mar. 29, 1996

[51] Int. Cl.[6] ..... B65B 41/14

[52] U.S. Cl. ..... 53/389.2; 53/64; 53/559

[58] Field of Search ..... 53/51, 64, 70, 53/559, 374.5, 374.6, 389.2

[56] References Cited

U.S. PATENT DOCUMENTS

| | | | |
|---|---|---|---|
| 3,000,157 | 9/1961 | Ollier et al. | 53/559 |
| 3,808,772 | 5/1974 | Turtschan | 53/559 X |
| 3,979,877 | 9/1976 | Vetter | 53/51 |
| 4,069,645 | 1/1978 | Vetter | 53/559 X |
| 4,141,196 | 2/1979 | Blanding | 53/374.6 X |
| 4,299,075 | 11/1981 | Gram | 53/374.6 X |
| 4,490,961 | 1/1985 | Raque | 53/374.5 X |
| 4,563,860 | 1/1986 | Pfankuch | 53/374.6 X |
| 5,269,123 | 12/1993 | Marchesini | 53/559 |
| 5,623,810 | 4/1997 | Dey et al. | 53/478 X |

*Primary Examiner*—Daniel Moon

*Attorney, Agent, or Firm*—Peter J. Thoma; Herbert J. Hammond; Jonathan E. Jobe

[57] ABSTRACT

Automated packaging of surgical needle-suture assemblies includes a framing operation in which adjacent sheets of polymer coated aluminum foils are conveyed through a sequence of steps in an apparatus which produces frames containing plastic packets of needle-suture assemblies. The apparatus pulls a web of foil off a large diameter feed roll and maintains web alignment as it travels down line through the apparatus by a system that optically detects transverse movement of the web as it is fed into the apparatus and adjusts the position of the feed roll relative to the centerline of travel using a hi-directional stepper motor. Discontinuities in the polymer coating on the top surface of the web of foil are automatically detected so that remedial steps can be taken to avoid processing defective sections of the web. A vision system having video cameras connected to a specially adapted computer enables monitoring the product travelling through the apparatus to detect various defects in the product formation. Upon detection of a defect, the computer system can either identify and separate rejected product from good product or shut down the apparatus. A servo drive system enables rapid and controllable advancement of the web down line in the apparatus.

5 Claims, 14 Drawing Sheets

APPARATUS FOR FEEDING FOIL STOCK IN A PROCESS FOR MAKING SEALED STERILE PACKAGES

CROSS-REFERENCE TO RELATED APPLICATIONS

This application is related to two commonly-assigned patent applications filed in the U.S. Patent and Trademark Office on the same day as this application, the first such application being entitled "Improved Surgical Suture Package with Peekable Foil Heat Seal" Ser. No. 08/623,874 filed Mar. 29, 1996, and the second such application being entitled "Method for Making Sterile Suture Packages" Ser No. 08/624,971 filed Mar. 29, 1996, now issued as U.S. Pat. No. 5,623,810, the disclosures of each of such applications being incorporated herein by reference.

BACKGROUND OF THE INVENTION

The present invention relates to the manufacture of sealed sterile packages and more particularly to method and apparatus for making sealed sterile packages for surgical sutures.

The foil stock for making sterile packages or containers for surgical sutures is provided on large rolls which are unwound during the feeding of the foil into the leading edge of the package making equipment. This foil stock becomes the bottom foil of the container. After cavities are formed in the bottom foil and the suture products placed therein, sheets of top foil are placed atop the bottom foil and the foils are subsequently sealed around the cavities. The facing surfaces of the foils are each coated with a thin polymeric film known as a seal coating, which facilitates sealing between the bottom foil and top foil. In the sealing operation, the seal coating melts to provide a seal between adjacent sheets of foil which are pressed together in selected areas by high temperature sealing dies.

As the foil stock or "web" comes off the source roll and is fed into the leading edge of a packaging machine, the traveling web has a tendency to "walk" in either transverse direction from the center of its longitudinal flow path through the machine. It is critical, however, that the web of foil be accurately aligned as it passes through the packaging equipment because lateral movement of the web relative to the centerline of the machine will reduce the seal margins resulting in suture packages with defective seals. This, in turn, results in significant "down time" as the process is halted to reposition the web. There is, accordingly, a need for an apparatus for maintaining alignment of the web of foil at the leading end of the packaging machine to ensure that the web is accurately positioned with respect to the centerline of the machine to increase the yield of usable foil, reduce downtime and increase product quality.

Discontinuities or voids in the polymeric seal coating on the foil occasionally occur due to imperfections in the foil manufacturing process. The presence of a discontinuity in the seal coating prevents effective sealing of the suture package, which results in product rejection. Since it is impractical to inspect the foil stock while it is on the roll, imperfectly sealed packages must be visually detected and removed following the manufacturing process, or the process must be halted whenever an imperfectly sealed package is detected so that such defective packages can be removed from the production line. This interferes with processing time and results in unnecessary processing of defective packages that must eventually be scrapped. There is, therefore, a need for an apparatus for continuously detecting seal coating imperfections in the foil stock during processing such that defective sections of the foil will not be used in the final product.

Production of sealed sterile packages for surgical sutures also requires rigorous inspection and quality control throughout the packaging process. Because of the possibility of various defects in the packaging process, and the significant cost of processing unfinished, defective products that will eventually have to be scrapped, detection of defects throughout the process is desirable to automatically identify defective products as the defects occur, and to diagnose and correct process conditions to minimize future defects. While the most significant of these inspections have heretofore been done by people, use of human operators to perform these tasks is costly and unreliable because such operators are highly susceptible to boredom and fatigue. Accordingly, there is a need for an optical inspection system which will detect defects as they occur in process and which will automatically alert the equipment operator upon detection of a particular defect so that remedial action can be taken.

The packaging equipment pulls the web of foil stock off the source roll and feeds it through a series of stations using what is known as a web advancement system. Heretofore, the web advancement system has been cam driven. The cam driven web advancement system advances the web of foil at a speed that is limited by the slow return stroke of the cam mechanism. The web advancement system moves the web from station to station and must repeatedly start and stop the web as it moves down line. Attempts to increase the speed of the cam mechanism, with resulting increased acceleration of the web, have caused web registration problems, which can result in sealing defects. Accordingly, there is a need for a web advancement system in which the overall process flow speed can be increased under controlled acceleration so that web registration problems can be minimized or eliminated.

BRIEF SUMMARY OF THE INVENTION

In accordance with one aspect of the present invention, a web alignment system is provided for ensuring that the web of foil is accurately positioned with resect to the centerline of its travel through the packaging machine. The roll of foil stock is mounted on a moveable carriage which is capable of transverse movement in relation to the centerline of the machine. A stepper motor, connected to a screw shaft, engages the mechanical carriage to move the roll of foil to the right or left of the centerline of the machine. A pair of optical sensors are located at the left and right edges of the web of foil as it enters the leading edge of the packaging machine. If the web "walks" too far to the right, the optical sensor on the right hand side sends a signal to a programmable logic controller which causes the stepper motor to move the carriage to the left. The optical sensor on the left hand side sends a signal to controller when the web has moved too far to the left, causing the stepper motor to move the carriage to the right. The controller controls the voltage sent to the stepper motor to cause the motor to rotate clockwise or counter-clockwise depending on whether a right or left misalignment condition is detected.

In accordance with a second aspect of the present invention, a skip detector is provided at the leading end of the packaging machine to automatically identify discontinuities in the polymeric seal coating to prevent a defective section of the foil from being used in the final product. The skip detector includes a plurality of spaced metal fingers which brush the surface of the web of foil as it is fed through the packaging machine. Adjacent fingers are connected to voltages of opposite polarity through a sensing circuit such that conduction of current through any two adjacent fingers occurs when adjacent fingers make contact with a metal foil surface where the seal coating is absent. When a coating discontinuity is detected, a sensing circuit sends a signal to the operator or to a frame unload station located downstream of the skip detector causing the defective section of product to be rejected and later separated from the flow of good products.

In accordance with a third aspect of the invention, an automated optical inspection system or "vision system" is provided for detecting defects in the product at certain points in the packaging process. Video cameras are directed at selected areas of the product to be inspected at various locations in the process. At each inspection point, a camera generates a real time image of the area to be inspected which is compared with the parameters of an expected image of a defect free product. An optical processor under the control of a programmable logic controller detects a fault condition whenever the real time image differs from a standard to a predetermined degree indicating that a defect has been detected. The programmable logic controller also sends a signal downstream to the frame unload station at the trailing end of the machine to cause the defective product to be separated from the flow of good products.

In accordance with a fourth aspect of the invention, a servo drive advancement system is provided for increased speed and lower acceleration of product as it is advanced resulting in reduction of registration problems and fewer sealing defects. A moveable carriage capable of reciprocal movement in the direction of travel of the web between the upstream end of the advancement system and the downstream end thereof is slidably supported on a pair of guide rails. The carriage includes a clamp for releasably gripping the web in response to action of pneumatically actuated cylinders. The carriage engages a screw shaft connected to a servomotor such that rotation of the screw shaft and servomotor in one direction causes the carriage to advance downstream in the direction of travel of the web and rotation of the shaft and servomotor in the opposite direction causes the carriage to return upstream to complete a cycle of movement. A programmable logic controller causes the servomotor to be selectively energized and controls the pneumatically actuated cylinders to precisely control the timing, speed and direction of travel of the carriage and the release and engagement of the web by the clamp.

DETAILED DESCRIPTION

Figure 1A:
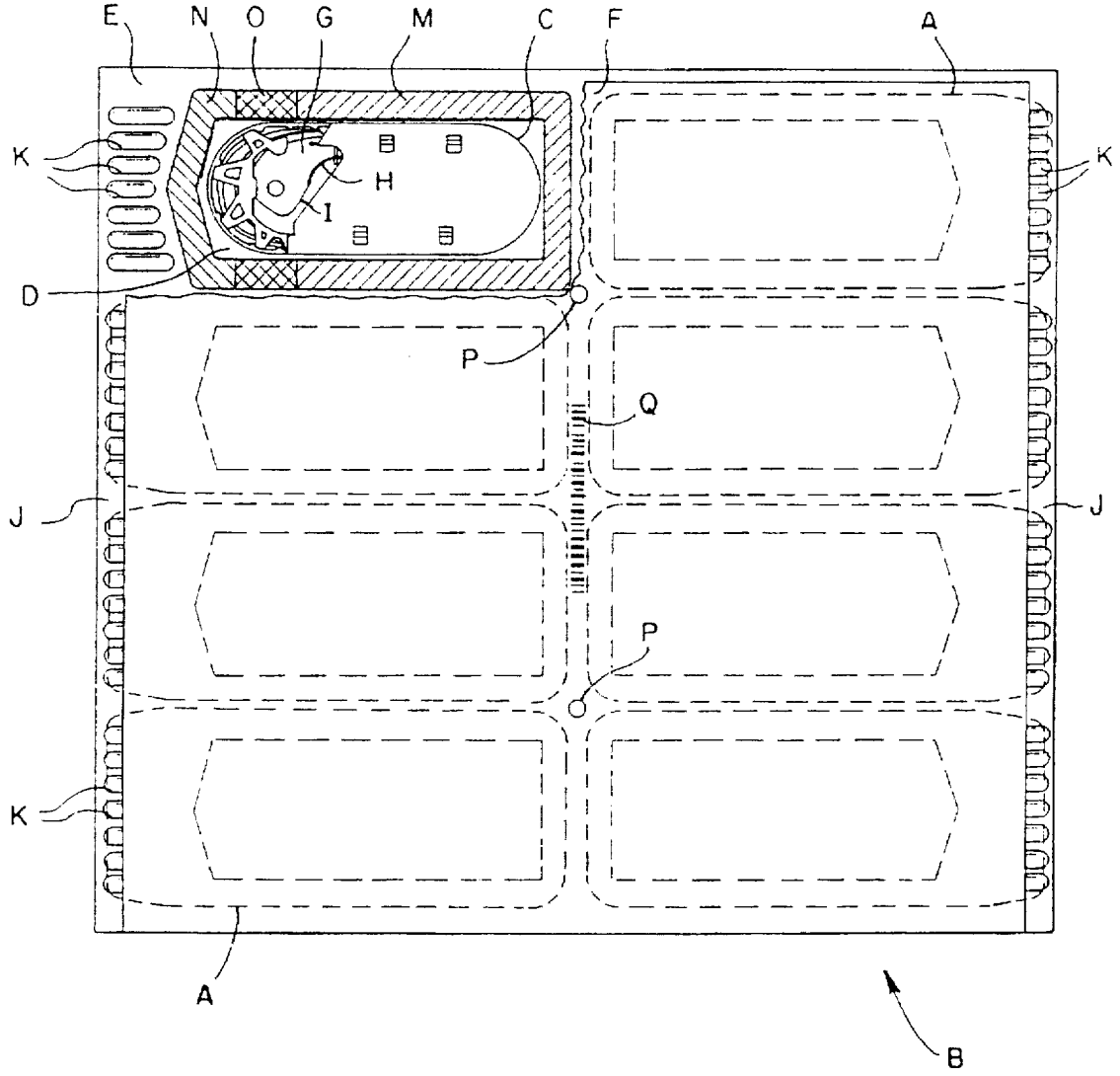
FIG. 1A is a plan view in accordance with the present invention of a frame of eight packages containing surgical suture packets with a top foil partially broken away to expose one such packet.

Referring to FIG. 1A, eight sealed sterile packages, two of which are designated by reference letter A, are provided in two rows of four per row in a common frame, which is indicated generally by the reference letter B. The frame B is shown at a stage in the manufacturing process following sterilization and sealing. The subsequent steps including a blanking operation, in which the individual packages (indicated in dashed outline) are separated from the frame, followed by final package inspection and boxing in cartons for shipment to the customer. The procedure described hereafter relates to the initial frame-forming steps which precede sterilization.

In the initial framing procedure, each package position receives an unsterilized surgical suture packet C, which is dropped into one of eight cavities D formed in a bottom foil E. The bottom foil E includes a vinyl or polymer-type coating on its top surface, which is heat sealed to a polymer coating on the bottom surface of a top foil F. The sealing method is described more completely in the aforementioned U.S. Pat. No. 5,623,810 filed Mar. 29, 1996, entitled "Method for Making Sterile Suture Packages" now U.S. Pat. No. 5,623,810.

Each surgical suture packet C comprises a plastic oval-shaped tray G for retaining a needle-suture assembly therein. The needle-suture assembly consists of a surgical needle H and a suture I, which is retained in a coiled-arrangement in the tray G. The blunt end of needle H is attached to the suture I in a well known manner, such as by insertion of the end of the suture into an opening or channel in the end of the needle and then crimping or swaging the end of the needle to tightly secure the suture thereto.

Bottom foil E is dimensioned to be slightly wider than top foil F so as to form an outer flange J along each of the sides thereof in which a series of ribs K may be formed as hereafter described to facilitate opening of the package during surgery. A pair of locating holes P is also provided in the scrap area between adjacent packages A to facilitate registration of the frame at operational stations in the packaging equipment. The locating holes P are aligned in the center of the frame B along the axis of travel through the packaging machine.

The apparatus and procedures of the present invention are adapted to making a variety of sterile packages including a preferred package described more fully in the aforementioned co-pending application Ser. No. 08/623,874 filed Mar. 29, 1996, entitled "Improved Surgical Suture Package with Peekable Foil Heat Seal." During the initial framing procedure described hereafter, a primary seal M is formed in a U-shape part way around each package A. Following sterilization, a secondary seal N is formed in a U-shape part way around each package A and overlapping the primary seal M to assure that the needle-suture assembly contained in each package remains in a sterile condition for use in surgery. The locations of the generally U-shaped primary and secondary seals are shown a cross-hatched areas surrounding the upper left cavity in FIG. 1A, the area of double cross-hatching labeled 0 indicating where the seals overlap. A bar code Q may also be provided in the scrap area of the frame B for product and lot identification.

Figure 1B:
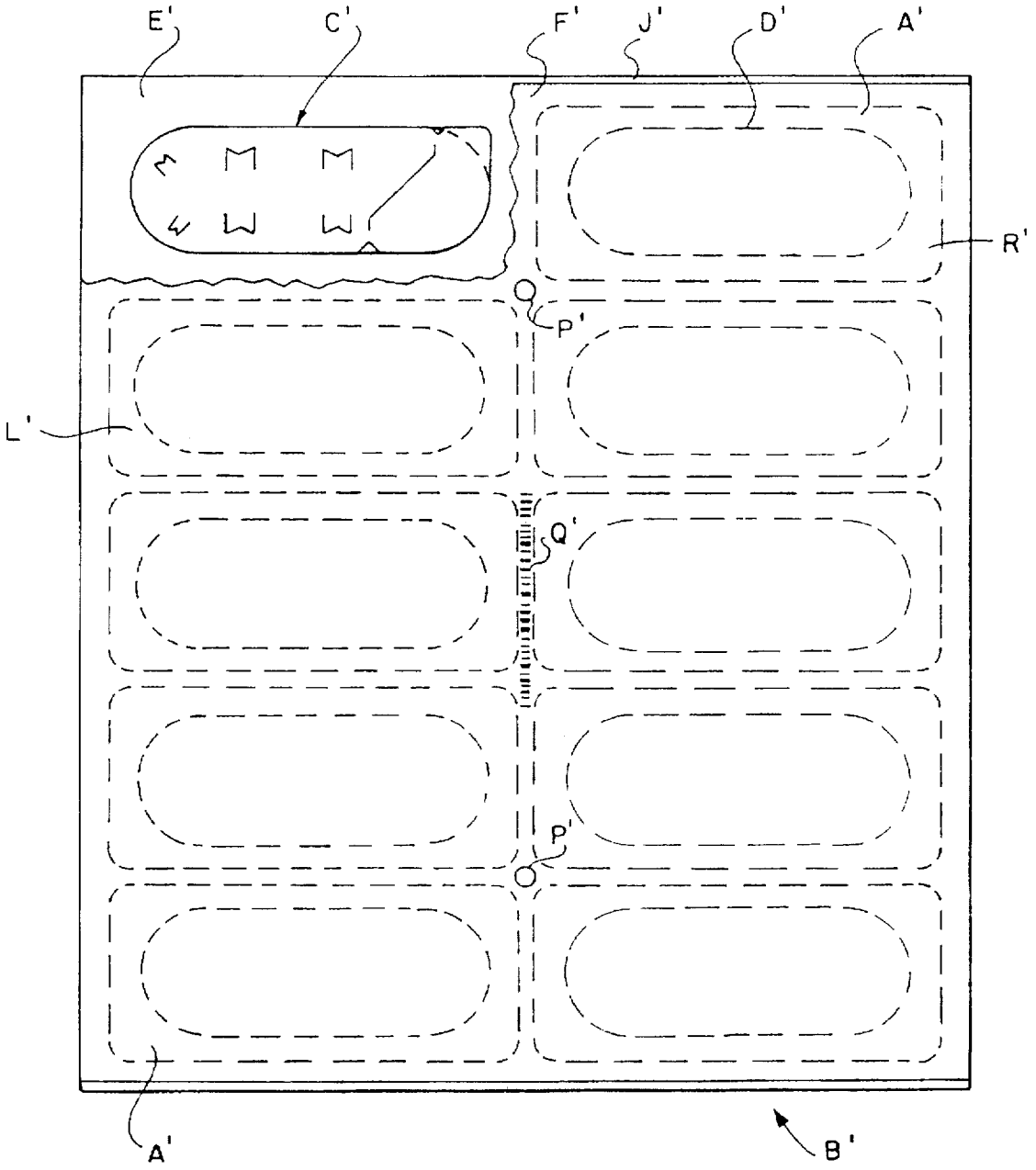
FIG. 1B (PRIOR ART)
FIG. 1B is a plan view of a prior art frame of ten packages containing surgical suture packets with a top foil broken away to expose one such packet.

Referring to FIG. 1B, a frame B' of prior art packages or containers A' is illustrated in top plan view. A suture packet C' is seen in the portion partially broken away lying in one of ten similar cavities D' formed in a bottom foil E'. A top foil F' covers the bottom foil E' and is sealed thereto around each cavity using identical polymeric heat seal coatings on the facing surfaces of the two foils. Flanges J' are provided as portions of the bottom foil E' extending beyond the edges of the top foil F' at the longitudinal ends of the frame B'. These flanges J' result from the gap between adjacent top foil sheets which facilitates placing top foil sheets on the bottom foil stock or "web" without interference between adjacent top foil sheets. The flanges J' are cut off as part of the foil scrap during the blanking operation which follows sterilization and separates the individual foil containers A' from the frame B'. Locating holes P' facilitate registration of the frame B' at successive stations as it moves through the packaging equipment. A bar code Q' may also be provided in the scrap area of the frame B' for product and lot identification.

A primary heat seal is formed prior to sterilization between and partially around the individual cavities but leaving the left edge L' and right edge R' unsealed. A secondary sealing operation following sterilization seals the left and right edges L' and R' of each frame B'. The frame B' has no unsealed side portions unlike the frame B of FIG. 1A. In use in surgery, the prior art packages A' are torn open whereas the packages A made in accordance with the present invention are peeled open by pulling apart unsealed flaps. This feature is explained more fully in the aforementioned co-pending application entitled "Improved Surgical Suture Package with Peelable Foil Heat Seal."

Figure 2:
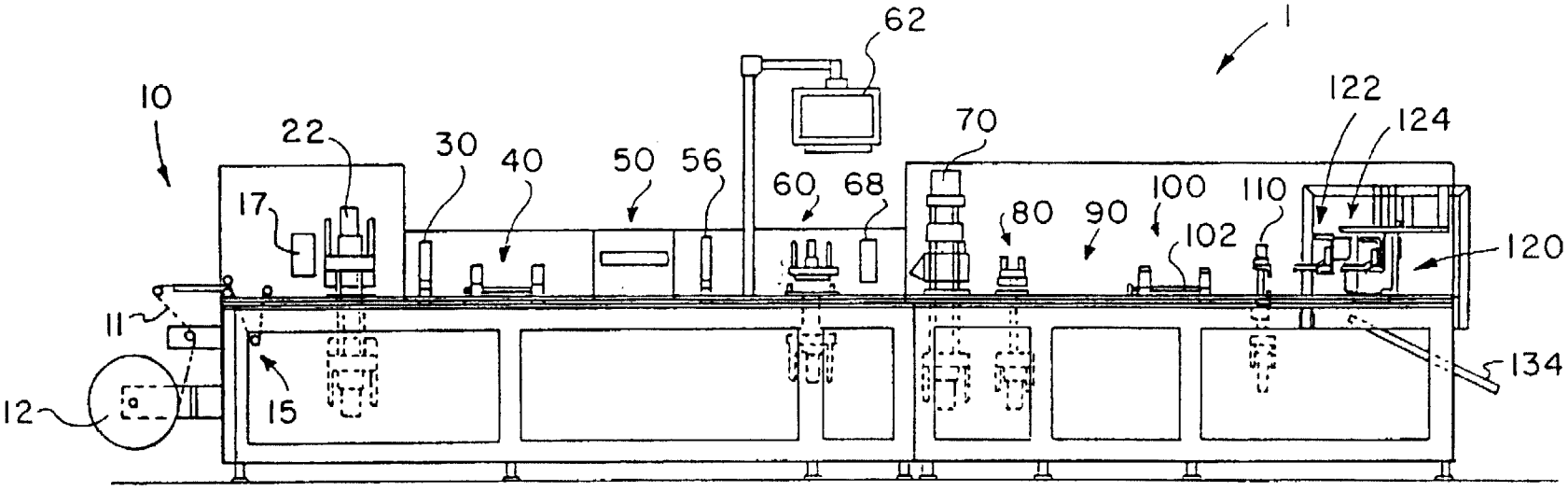
FIG. 2 (PRIOR ART)
FIG. 2 is a side schematic view of a prior art packaging machine used in the production of sterile packages for surgical sutures.
Figure 3:
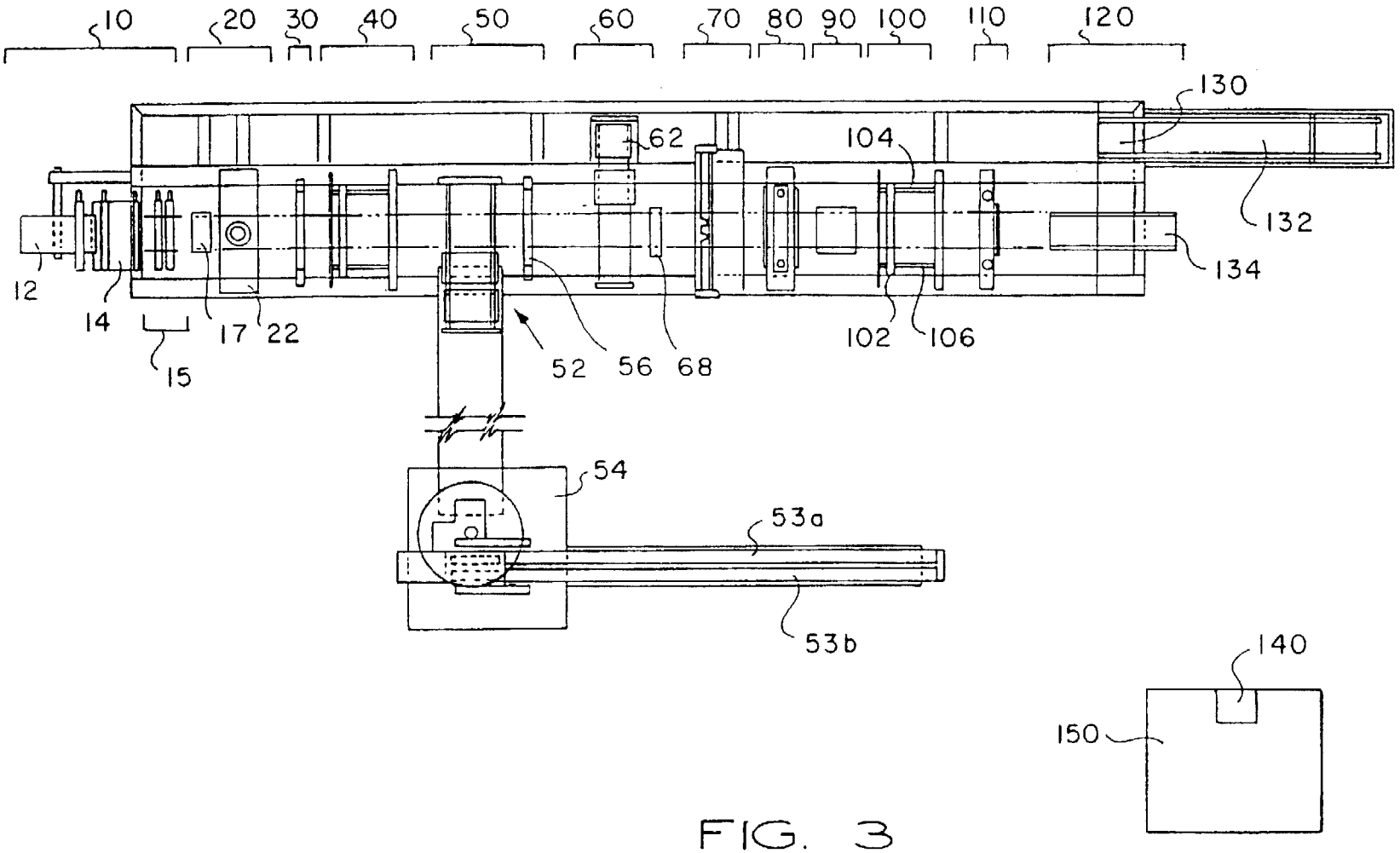
FIG. 3 (PRIOR ART)
FIG. 3 is a plan schematic view of a prior art packaging machine used in the production of sterile packages for surgical sutures.

FIGS. 2–3 illustrate in schematic side and plan views, respectively, a prior art packaging machine 1 formerly used in the initial steps of making prior art frames of the type shown in FIG. 1B. The manufacturer of the principal components of the machine is Harro Höfliger Verpackungsmaschinen GmbH of Allmersbach im Tal, Germany (hereinafter "Höfliger"). The machine 1 feeds foil stock through a series of stations, including a foil feeding station 10, a cavity forming station 20, a microvoid detection station 30, slave web index station 40, packet loading station 50, top foil loading station 60, sealing station 70, hole punch and chilling station 80, vision system station 90, master web index station 100, cutting station 110 and a frame unload station 120. Advancement of the web and operation of the above stations are controlled by a programmable logic controller ("PLC") 140 mounted in a main control cabinet 150.

In foil feeding station 10, foil stock 11 is provided on large rolls 12 which are unwound during the feeding of the foil stock into the leading end of packaging machine 1. The foil stock 11 is commonly referred to as the "web" after it has been unrolled from roll 12. Foil stock 11 consists of aluminum foil coated with a polymer coating, which is used to form a heat seal as described below. Foil stock 11 forms the bottom foil E' of the frame B'.

Foil stock or web 11 passes over rollers into the leading edge of machine 1 onto a splicing table 14. Splicing table 14 is used to splice together consecutive rolls of foil stock to maintain the continuity of the web fed into the machine so that the process does not have to be interrupted for an extended duration each time a roll of foil stock is depleted and new roll is provided.

A roll unwind station 15 is provided for feeding the web of foil off of the roll. The roll unwind station 15 employs a tensioning system containing a series of tension rollers which interact with foil feeding station 10 to ensure that the web, as it is advanced through the machine, is not pulled directly off roll 12.

A splice detector 17 optically detects the presence of a splice formed between consecutive rolls of stock. When a "splice" is detected, a signal is sent to the PLC 140 indicative that a "splice" is present at a particular location of the advancing web. The location is stored in the PLC 140, which subsequently causes the frame containing the splice to be "rejected" from the product flow downstream at the frame unload station 120.

At the next step of the process, the web of foil 11 is advanced to cavity forming station 20, where the web is clamped, then subjected to compressed air and impact from a forming die 22 to form cavities in the web, which later becomes the bottom foil E' containing cavities such as cavity D'. The web next advances to microvoid detection station 30 which contains a pinhole detector to detect the presence of "pinholes" in the preformed cavities. The pinhole detector (not shown) includes an infrared light source and an infrared light detector on opposite sides of the web. If a pinhole is detected, a signal is sent to the PLC 140 which stores the location of the defect in the web so that the frame containing the pinhole can be subsequently separated from the good product flow at the frame unload station 120.

In the prior art Höfliger machine shown in FIGS. 2 and 3, a slave web index system 40 was included, but with poor results. It was intended to facilitate the indexing or advancement of web material in response to and under the control of the master web index system 100 located downstream thereof. However, the slave web index system was not perfected and was not employed beyond an experimental stage, because it was found to add too much inertia to the system.

When the web reaches packet loading station 50, individual suture packets C' (FIG. 1B) are loaded into the cavities D' by a pick and place mechanism, schematically illustrated in FIGS. 2 and 3 and designated by reference number 52. Vacuum pickup heads (not shown) pick up ten suture packets C' and place them into the preformed cavities in a 2×5 array in frame B' as shown in FIG. 1B. The packets are conveyed in pairs perpendicular to the web flow on cogged conveyor belts 53*a* and 53*b* and loaded into magazines at a feeder station 54 where they are then conveyed in groups to the pick and place mechanism 52. The web next advances to packet detector 56 which checks for the presence of a packet in each cavity D'.

A top foil load station 60 overlays a sheet of top foil F' on a section of bottom foil containing ten cavities. This step is repeated during each pause in the advancement of the web down line. The top foil F' has preprinted printed label indicia on its top surface. Small spots at corners of the top foil F' are heated to locally fuse the seal coatings on the facing surfaces of the two foils. This "tacking" operation keeps the top foil F' in proper position relative to the underlying web as they move together down line.

An operator interface 62 is provided adjacent to the top foil load station 60 to allow the operator to communicate with the PLC 140, which controls the timing and operation of each of the stations. The operator interface 62 allows the operator to start and stop the machine as well as to enter other functions. Label check station 68 employs a photoelectric system to check for the presence of a distinctive color on the product indicative of the presence of a top foil. If no "label" is detected, check station 68 sends a signal to the PLC 140 to stop the machine, since the continuation of operations under such conditions would result in significant waste of product.

At sealing station 70, the top foil F' is selectively heat sealed to a section of the web (which later becomes the bottom foil E') by sealing dies (not shown) along the leading edge, inside edge and trailing edge of each package position. This causes the heat seal coatings on the two foils to fuse together to form a "primary" seal surrounding each cavity D' on three sides. The side of each cavity at the left and right edges L' and R' (FIG. 1B) remains unsealed until after a subsequent sterilization procedure when a "secondary" seal is formed to entirely seal each cavity.

The web is then advanced to hole punch and chilling station 80, where locating holes P' (FIG. 1 B) are provided in the sealed foils in the center scrap area for subsequent registration of the secondary sealing, blanking and cartoning operations, which follow sterilization. Chilled water runs through a metal manifold (not shown) over which the web is advanced to remove some of the heat retained from the heat sealing process performed in the preceding step.

At station 90, a vision system employing three video cameras performs inspections of the bottom surface of the web and determines whether the registration holes P' are properly located, whether any cavities have been crushed, and checks for seal integrity.

In the prior art Höfliger machine 1, master web index system 100 employs a cam driven mechanism (not shown) that moves a reciprocating mechanism 102 to advance the web. At the beginning of a cycle, the mechanism 102 clamps the web at the upstream end of the station 100. The mechanism 102 is then advanced along a pair of guide rails 104 and 106 to the downstream end of the station 100, where the web is released and the mechanism 102 is returned to the upstream end of the station to begin the next cycle.

At cutting station 110, the web is cut into frames containing two rows of five packets A' via a scissors cutter mechanism (not shown). The frame unload station 120 sorts the good and rejected frames in accordance with signals stored and sent from the PLC 140. A guide rail 122, moveable under the control of the PLC 140, pushes acceptable product to one side where a vacuum pickup 124 picks up the good frames and places them onto a loading station 130. Carriers (not shown) are moved into the loading station 130 on a feed line 132. Once loaded, the carriers are stacked on a vehicle (not shown) for transportation to a sterilization area within the manufacturing facility. Rejected frames are dropped off the end of the conveyor onto a reject chute 134 and then into a reject bin (not shown).

Figure 4:
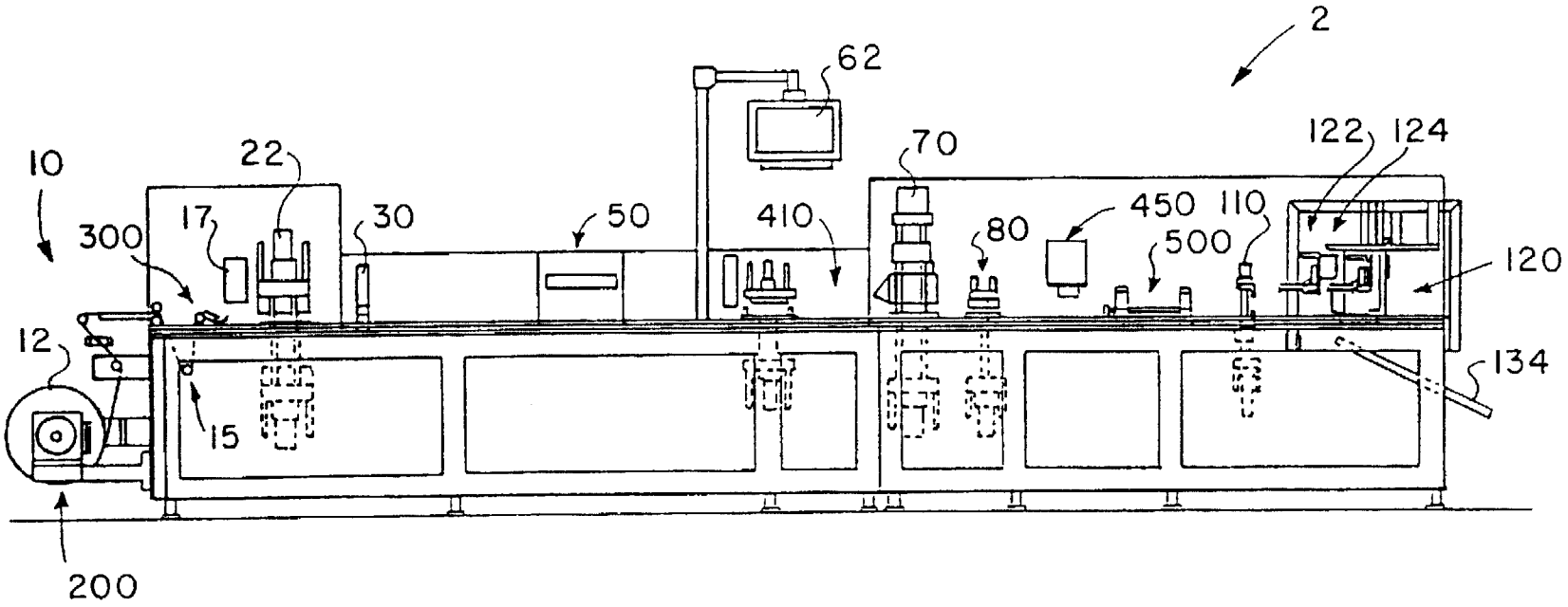
FIG. 4 is a side schematic view of a modified packaging machine incorporating the features of the present invention.
Figure 5:
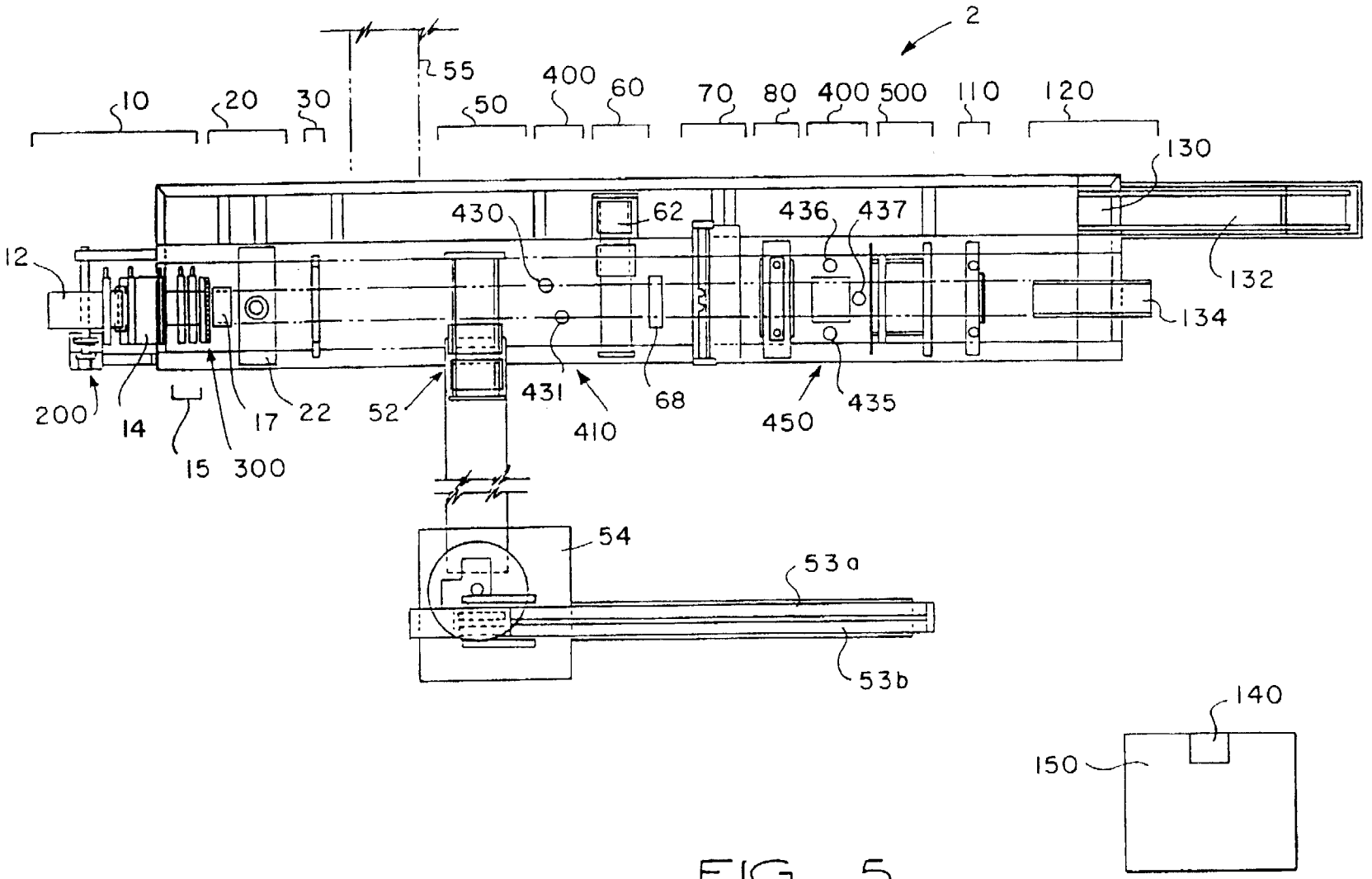
FIG. 5 is a plan schematic view of a modified packaging machine incorporating the features of the present invention.

Referring now to FIGS. 4 and 5, a schematic representation of a modified Höfliger machine 2 is shown incorporating the improvements of the present invention, like numerals designating the same or similar parts previously described. The cavity forming station 20 is similar to the corresponding station in the prior art Höfliger machine except that the forming die 22 is modified to produce a larger cavity D as well as the stiffness-adding ribs K in the side flanges J of frame B (FIG. 1A). The preferred shape of the cavity and the orientation and number of ribs are described in the aforementioned co-pending application entitled "Improved Surgical Suture Package with Peelable Foil Heat Seal."

Suture packet conveyors **53*a* and 53*b* as well as packet magazine station 54 and the loading station 52 comprise a feeder system similar to that used in the prior art machine previously described. A second such feeder system 55** (shown partially in phantom) may also be used to supply a different packet to the main foil line to facilitate the conversion of the line from packaging one type of packet to another.

A web alignment system 200 is positioned between the roll 12 of foil stock and the splicing station 14. As described in greater detail below, web alignment system 200 is designed to maintain accurate alignment of the foil stock as it is introduced into packaging machine 2.

A skip detection system 300 is provided between the roll unwind station 15 and splice detector 17. The skip detection system, as hereafter described, detects imperfections in the foil stock during processing so that the process can be halted and the defective sections of the web of foil removed or the entire roll 12 of foil stock replaced.

A vision system 400 is provided for automatically inspecting the packaging process and product for certain likely defects. Vision system 400 includes a first set of cameras at station 410, which replaces packet detector 56 (FIGS. 2–3), and a second set of cameras at station 450 immediately downstream of the hole punch and chilling station 80. Due to the added complexity of the dual-station vision system 400 of the modified Höfliger machine 2 of FIGS. 4 and 5 compared to the prior art machine, a more sophisticated computer control system 150 with associated optical processor and PLC elements is employed, as will be appreciated from the detailed description provided below.

In the modified Höfliger machine, the cam-driven web advancement system 100 of the prior art machine has been removed and replaced by a servo drive system at station 500 as hereafter described in connection with FIGS. 17 and 18. As the web of foil travels through modified packaging machine 2, servo drive system 500 controls the advancement of the web through the machine in a way that enables faster product flow.

Web Alignment System

Figure 6:
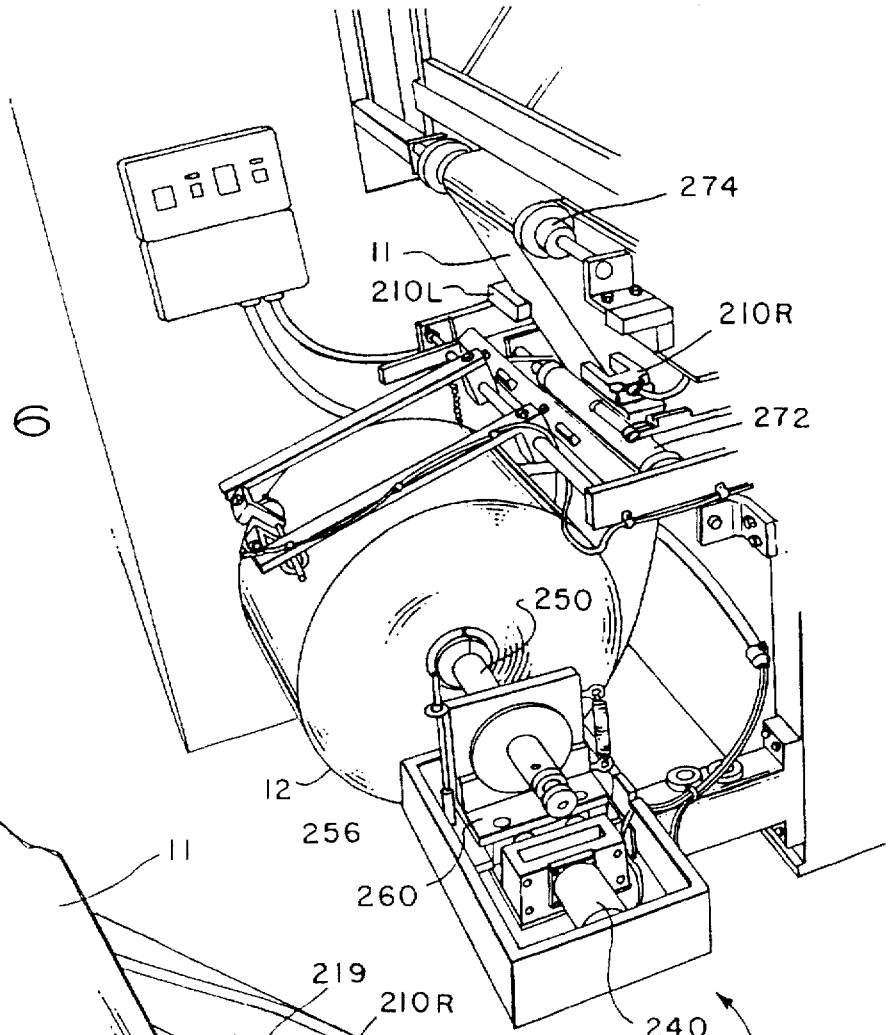
FIG. 6 is a perspective view of the web alignment system of the present invention.

FIGS. 6–9 illustrate the web alignment system 200 of the present invention which comprises a pair of U-shaped optical sensors 210L (left) and 210R (right) electrically connected to controller 220 in a control circuit 230, which, in turn, controls the application of voltage to a stepper motor 240. As shown in FIG. 6, a roll 12 of foil stock is rotatably mounted on a slidable shaft 250, which is supported by and capable of limited axial movement within a journaled housing 256. A corresponding housing (not shown) is provided on the opposite side of roll 12 for supporting shaft 250. Housing 256 is mounted to and supported by a chassis 260, which is movable in the axial direction to provide precise transverse adjustment of the web relative to its direction of travel down line.

Figure 7:
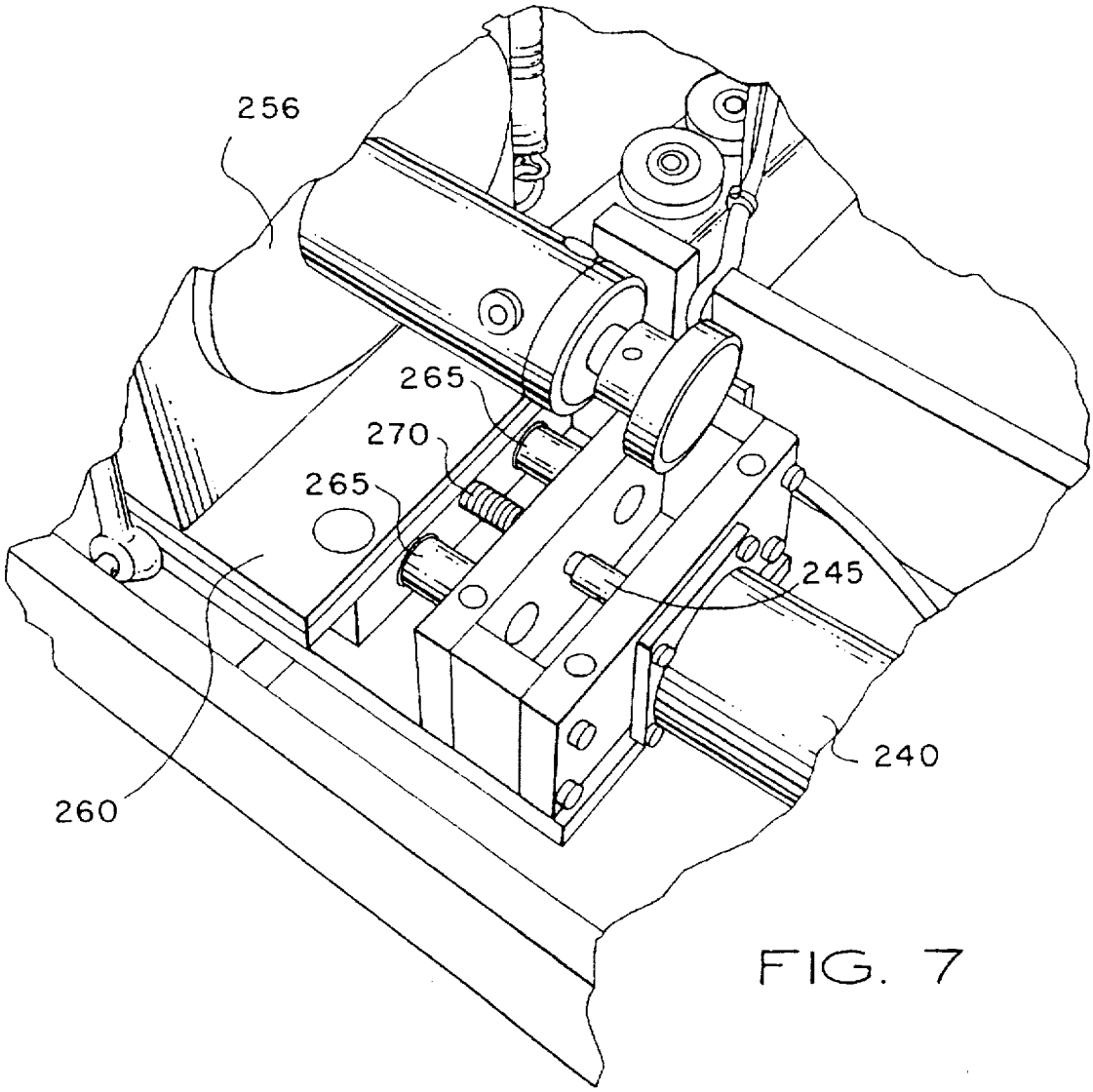
FIG. 7 is a perspective view of the drive mechanism of the web alignment system shown in FIG. 6.

As best seen in FIG. 7, shaft 245 of stepper motor 240 is connected to a screw shaft 270, which, in turn, passes through and threadedly engages the underside of moveable chassis 260. The chassis 260 is slidably supported on each side by a pair of guide rods 265 extending through the bottom of the chassis on opposite sides of screw shaft 270. Chassis 260 moves to the right or to the left relative to the centerline of the machine depending on whether the stepper motor 240 is powered in a clockwise or counterclockwise direction. The motor 240 may be any suitable stepper motor, such as the type S-57-102 manufactured by Compumotor of Robert Park, Calif.

Figure 8:
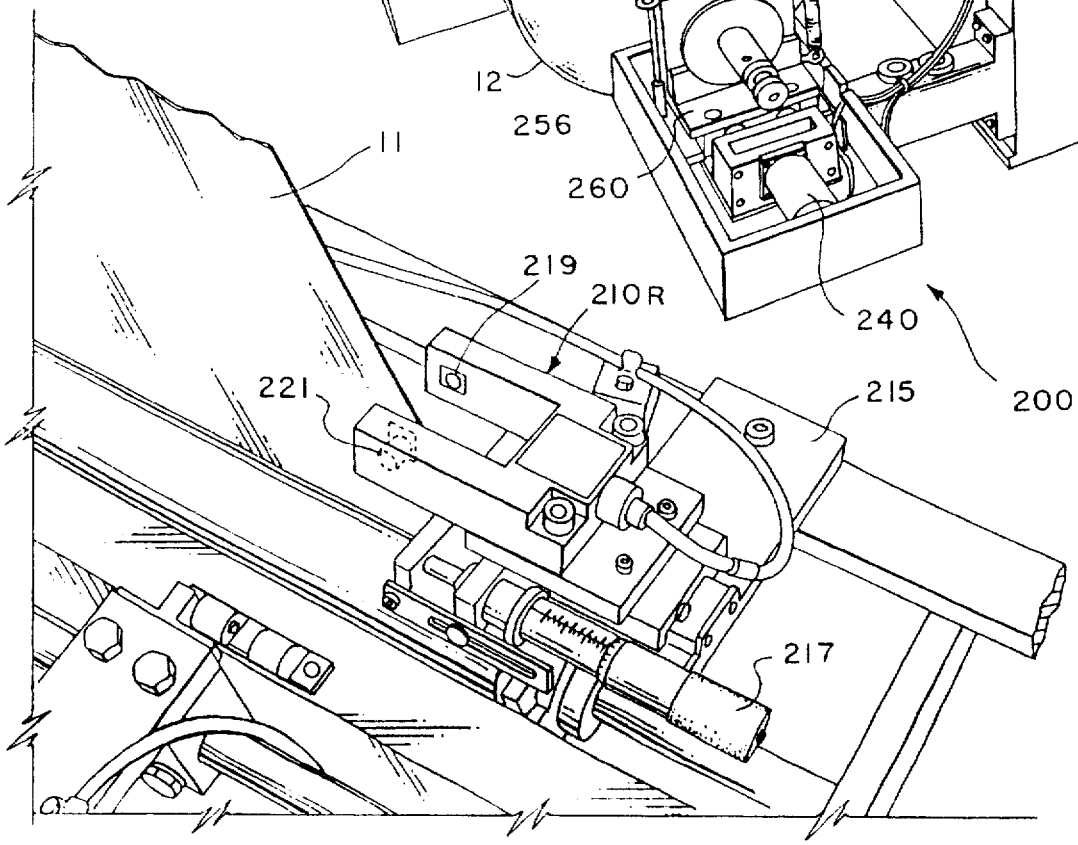
FIG. 8 is a perspective view of the optical sensors employed in the web alignment system shown in FIG. 7 illustrating the interaction of the sensors and the web.

As the foil stock comes off the roll and is fed into the machine, the web of foil is fed between two rotating feeder rollers 272 and 274 (FIG. 6). As best seen in FIG. 8, the web 11 is threaded between the flanges of two U-shape optical sensors mounted adjacent the left and right hand sides of the web (only optical sensor 210R being visible in FIG. 8). In the preferred embodiment, U-shaped sensors 210L and 210R are infra red photoelectric switches such as type E35-GS384 manufactured by Omron Corporation of Schaumburg, Ill. Sensors 210L and 210R are mounted on a moveable platform 215 which facilitates precise positioning of the sensors relative to the edges of the web 11 by calibrated adjustment screws such as screw 217. Each optical sensor employs a through beam infra red photo sensor comprising an infra red source 219 and a photoelectric cell 221 (FIG. 8). If the web "walks" sufficiently far to the left or to the right to block the beam, the photoelectric cell 221 will not see the light source and will no longer generate a current.

Figure 9:
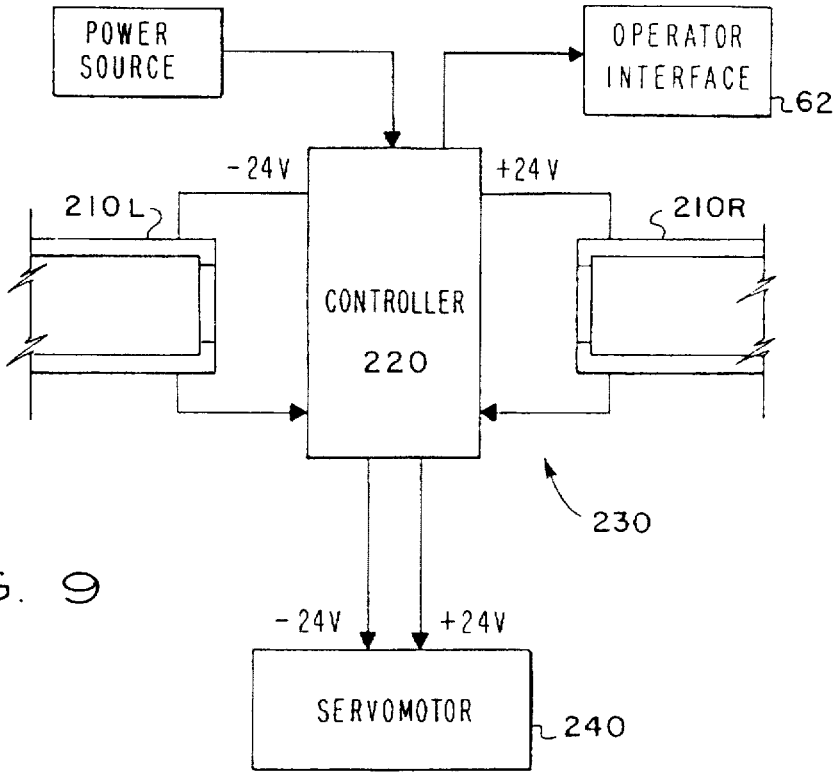
FIG. 9 is a schematic diagram of the control circuit of the web alignment system illustrated in FIG. 6.

FIG. 9 schematically illustrates the control circuit 230 of the web alignment system. When the controller 220 detects a "no current" condition from either sensor 210L or 210R, it will switch a voltage of appropriate polarity to stepper motor 240, causing chassis 260 to be advanced so that the edge of the web will move inwardly toward the centerline of the machine. When the web is in perfect alignment, the sources 219 will each be seen by the respective cells 221. If the web should move out of alignment to the right, for example, the right edge of the web will block the beam in right sensor 210R, and the stepper motor will be powered to move the chassis 260 to the left until the right edge of the web no longer blocks the source in sensor 210R, and vice versa. Controller 220 can also be programmed to detect a "fault" condition which occurs when both sensors 210L and 210R detect a "blocked field of view" condition causing a signal to be sent to the operator interface 62 indicative of a sensor failure. Controller 220 may be any solid state controller, such as, for example, part SX6 manufactured by Compumotor.

The foregoing web alignment system enables precise positioning of the web relative to the leading edge of the machine, resulting in a higher percentage of products placed properly in the cavities formed in the web and properly positioned top foils, eliminating waste and improving process yield.

Skip Detection System

Figure 10:
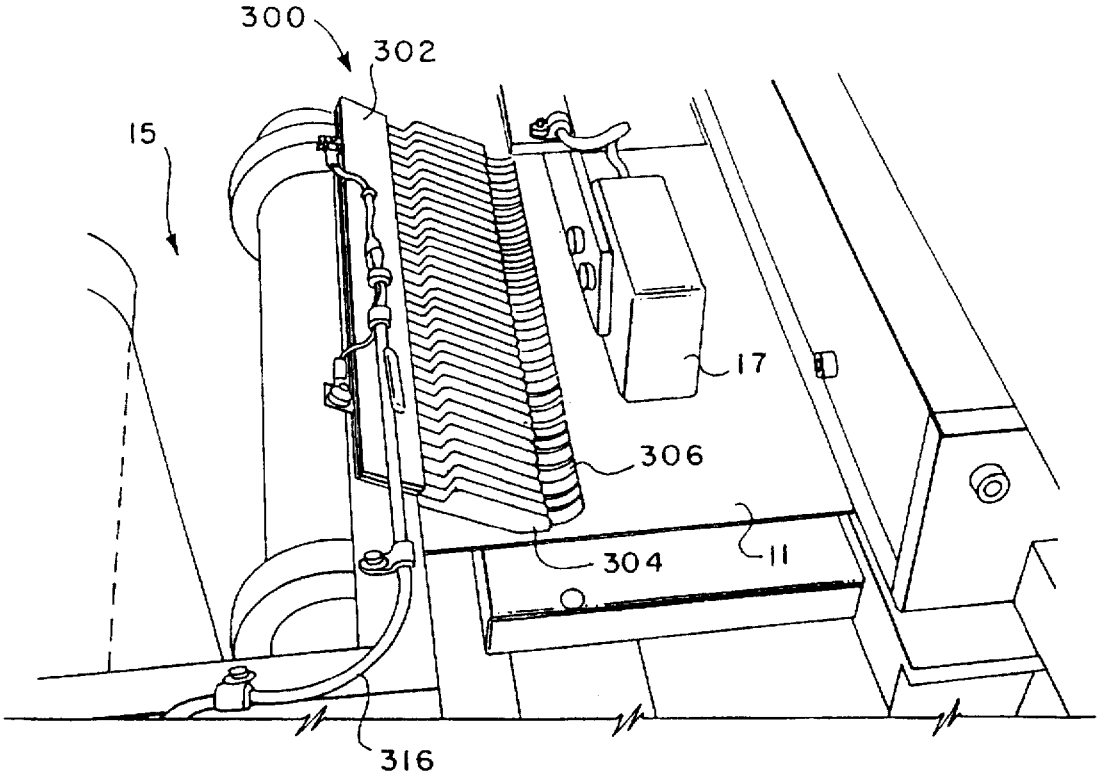
FIG. 10 is a perspective view of the skip detection system of the present invention.

Referring now to FIG. 10, a skip detection system 300 is shown positioned between the roll unwind station 15 and the splice detector 17 in the modified Höfliger machine 2. Skip detection system 300 includes a spine member 302 connected to a series of parallel channel members 304 for retaining a plurality of flexible metal fingers 306. Channel members 304 are oriented relative to the web 11 such that the metal fingers 306 extending therefrom brush the surface of the web as the web advances from the roll unwind station 15 to the splice detector 17. Fingers 306 are biased to make mechanical contact with the web at all times and to make electrical contact with the metal foil whenever voids occur in the polymer coating. Metal fingers 306 are preferably formed of a flexible metal material, such as spring steel. In the preferred embodiment, 50 fingers, approximately 0.25 inch wide and spaced apart approximately 0.0625 inch provide the ability to detect discontinuities or voids in the seal coating on the web down to a size of about 0.50 inch in diameter. The resolution of the skip detector can be increased by appropriately adjusting the placement, thickness and number of fingers 306 to detect voids of smaller diameters.

Figure 11:
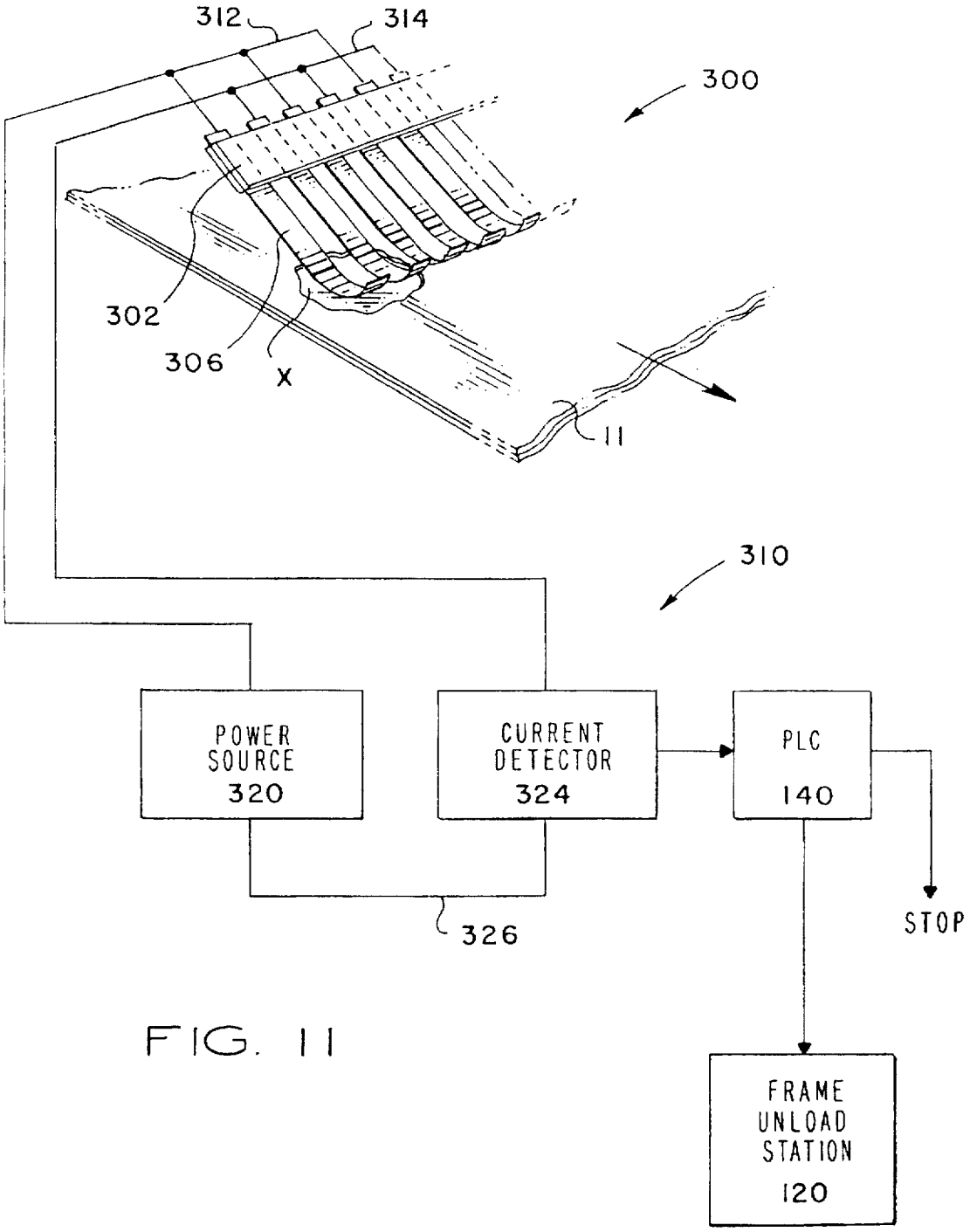
FIG. 11 is a schematic diagram of the circuitry of the skip detection system shown in FIG. 10 and illustrating the manner in which a discontinuity in the foil coating is detected.

FIG. 11 illustrates the circuitry of the skip detection system 300 and the manner in which fingers 306 detect discontinuities in the web seal coating. A circuit 310 is provided for detecting the presence of a void and for generating a signal indicating that a discontinuity or void has been detected. Adjacent fingers 306 are alternately connected to cables 312 and 314, respectively. Cables 312 and 314 are contained within a sleeve 316 (FIG. 10) leading from spine member 302 to circuit 310. Circuit 310 contains a power source 320, connected to cable 312 and a current detector 324 connected to cable 314. A cable or line 326 electrically connects the power source 320 and current detector 324 as shown. A suitable current detector for this application is a current limiting and safety device such as type number MLT3000 manufactured by Measurement Technology, Inc.

When adjacent fingers 306 brush against and make contact with the metal foil at a discontinuity X in the web seal coating, a closed loop is completed in circuit 310 and a current produced by power source 320 is detected by current detector 324. Upon detection of a current, detector 324 sends a signal indicating that a discontinuity has been detected to the PLC 140, which is programmed to stop the machine so that the damaged segment of foil can be removed. Alternatively, the signal sent to the PLC 140 can be processed and stored to reject product formed from that segment as it comes off the end of the machine at frame unload station 120 (FIGS. 4 and 5). In this case, PLC 140 will send a reject signal to frame unload station 120 at the appropriate time.

Vision System

The vision system 400 in the modified Höfliger machine 2 is used to automatically monitor the packaging process and to inspect the packages for a variety of defects at two locations on the Höfliger machine. Depending on the defect, the vision system will either signal the PLC 140 for package rejection or machine realignment. The system performs a number of checks, including inspections for (1) presence of tray G; (2) presence of a paper lid on the tray; (3) the presence of foreign matter in the secondary seal area; (4) the presence of foreign matter in the primary seal area; (5) proper positioning of locating holes P; (6) cavity crush; (7) presence of printing or labelling on the top foil; (8) printing of the bar code Q in the scrap area; (9) bent corners on the top foils; and (10) travel of the web perpendicular to the centerline of the machine.

Referring to FIGS. 4, 5, and 12–16, the vision system 400 is deployed at two stations 410 and 450. The prior art packet detector 56 (FIG. 2) is removed from the Höfliger machine and replaced by the first station 410 of the vision system. The second station of the vision system of the present invention is at the same location on the modified Höfliger machine as on the prior art machine (i.e., station 90 in FIG. 2), but is more sophisticated and checks for more potential defects. The second station 450 is positioned between chilling station 80 and servo web mechanism 500. Each station comprises a set of video cameras for real time inspection of the product passing therethrough. A suitable video camera is the Sony Model No. XC-77RR camera. The stations preferably have a total of eight such video cameras 430–437, each of which is connected to an optical processor 440 (FIG. 14), which, in turn, communicates with the PLC 140 through a converter module 441. The processor 440 receives video signals from each camera and interprets them to generate signals for communication to the PLC 140.

The inspections occur in the first station 410 of the system on the fly, while the web is advancing after the packet has been placed in the cavity but before top foil loading. At station 410 the vision inspection system detects: (1) the presence of tray G; (2) the presence of a paper lid on tray G; (3) the presence of foreign matter in the secondary seal area; and (4) the presence of foreign matter in the primary seal area.

Figure 12:
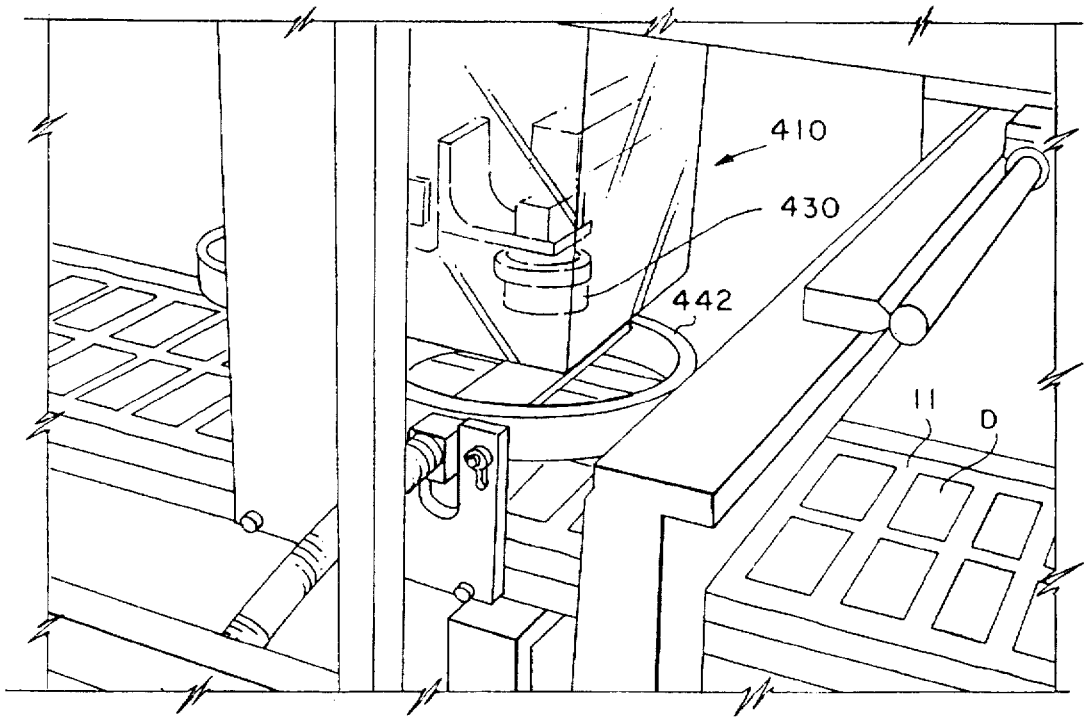
FIG. 12 is a perspective view of a first stage of the vision system of the present invention.

As best seen in FIG. 12, the first station 410 of the system contains a pair of video cameras 430 and 431 (only camera 430 being visible in FIG. 12), which are mounted vertically above and looking down on the advancing web 11 (shown schematically). The video cameras are positioned on opposite sides of the centerline of the machine, such that one camera will image advancing cavities in the near lane and the other camera will image advancing cavities in the far lane. A rheostat controlled light source 442, such as a Fostec 8370 or other suitable light source, illuminates the web. A fiber optic sensor 444 (FIG. 14), such as Keyence FS2-60 switch, manufactured by Keyence Corporation, signals cameras 430 and 431 to record an image of the cavity when a pair of advancing cavities D in the web triggers the sensor. Images from cameras 430 and 431 are processed by optical processor 440, as hereafter described, to determine if any of the above defects have been detected. If a tray, paper lid, needle, suture or any other matter in the secondary or primary seal areas is detected, a fault signal is sent to the PLC 140. If any such foreign matter is detected, a SUTURE IN THE SEAL fault signal is generated indicating the specific lane (near side, far side) in which the fault is detected. Similarly, if a packet tray is not detected or a properly positioned paper lid is not detected, a TRAY NOT PRESENT fault signal or PAPER COVER MISSING fault signal, respectively, is generated for the specific lane in which the defect occurs. If, for some reason, an inspection cannot be performed, a TRIGGER NAK (trigger not acknowledged) signal will be generated. PLC 140 may be programmed to send a message to the operator interface 62 indicating that a problem has been detected in the process.

The second station 450 of the vision system has six cameras 432–437 (three top-down looking cameras and three bottom-up looking cameras), which are employed to check for various defects in the product or manufacturing process after primary seal formation. The three bottom-up cameras 432–434 check for (1) the presence of suture product in the seal area around the primary seal after sealing; (2) locating hole registration; and (3) cavity crush caused by improper registration between the sealing and forming stations. These three product inspections are essentially the same as those performed by the vision system of the prior art Höfliger machine 1 at station 90 (FIGS. 2 and 3).

Two of the three top-down cameras 435 and 436 (FIG. 5) are positioned in parallel but offset from the centerline of the machine 2 over the near and far lanes to determine if the corners of the top foil sheets are folded back. Each camera 435, 436 simultaneously images the trailing edge corner of a passing top foil and the leading edge corner of the next advancing top foil to determine if the corners of the foil sheets are folded back. The third top-down camera 437 at station 450 is positioned over the centerline of the machine to check if the bar code Q (printed on the top foil) is in the center of the foil sheet (i.e. in the scrap area), and if the top foil itself is present, which is confirmed if a bar code Q can be detected.

Figure 13:
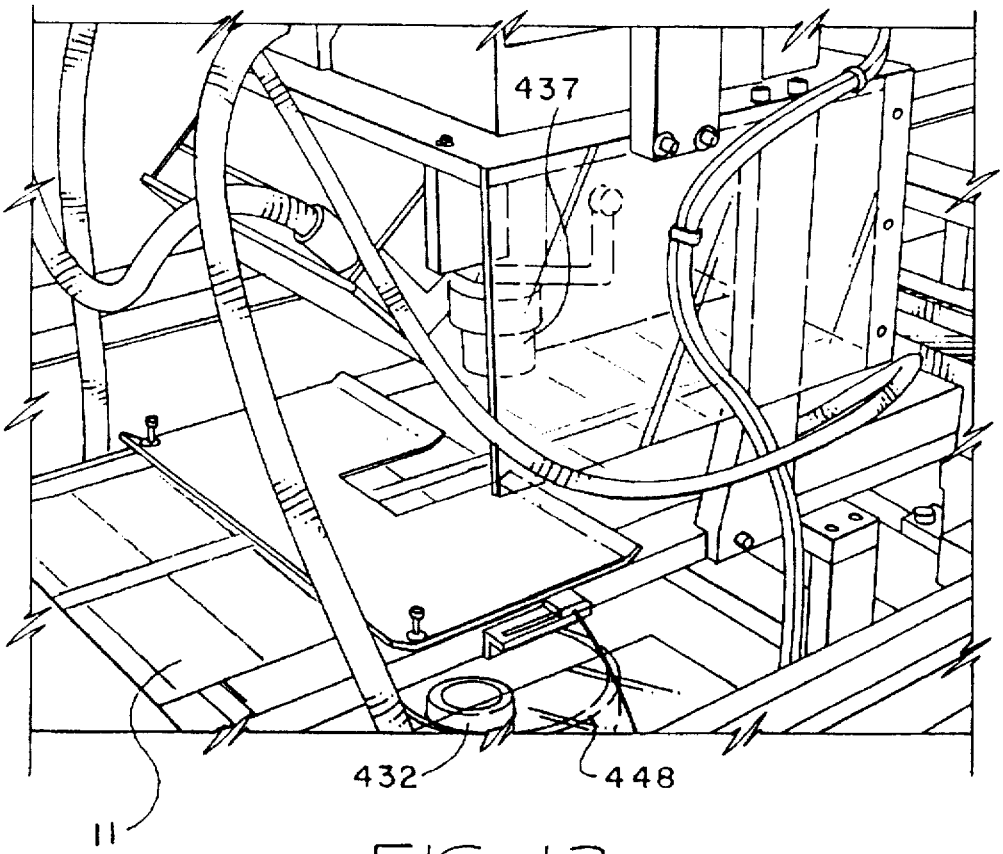
FIG. 13 is a perspective view of a second stage of the vision system of the present invention.

FIG. 13 illustrates the second station 450 of the vision system. Bottom-up cameras 432–434 (only camera 432 being visible) are positioned in the center and on opposite sides of the centerline of the machine in a staggered relationship. A controlled light source 448 is also provided to illuminate the bottom side of the web for each of the cameras. The light is reflected off the bottom surface of the web and is "seen" by the camera as shades of gray, the flat surfaces in the plane of travel appearing near white and the contours of the cavities appearing dark gray. Thus, an irregularity in a flat surface such as the seal area will appear darker than expected and can thus be detected. For example, a needle trapped in a seal will appear as a dark line (due to the shadow effect) in what should appear as a uniformly light area.

As the cavity D breaks the fiber optic beam sensor 444 (FIG. 14), a trigger from the PLC 140 causes camera 432 to record the image of the foil cavity. If foreign matter is detected in the area around the primary seal, a MASTER FAULT signal will be sent to the PLC 140. If the vision system does not have time to perform the inspection, a TRIGGER NAK signal will be sent to PLC 140. In either case, the PLC will cause the corresponding package to be rejected downstream by sending a "reject" signal to the frame unload station at the appropriate time. A second bottom-up looking camera 433 (not shown) performs a similar inspection of the seal area on the other side of the centerline. These seal integrity inspections are done on the fly as the web is being advanced.

The third bottom-up camera 434 (not shown) checks for cavity crush and inspects for hole registration during the dwell between advancement cycles. PLC 140 generates a trigger during dwell that causes camera 434 to capture an image of the locating holes P in the frame. Theoretically, the center of the locating holes should coincide with the centerline of the space between the cavities. If the hole location is more than ±0.040 inches from the nominal, the package will be rejected. Each cavity is formed with a nominal width of 1.719 inches. Cavity crush occurs if there is a negative variation in cavity width of more than 0.040 inches. Cavity crush occurs when the forming dies 22 in foil forming station 20 are not in proper registration with the sealing dies 72 in sealing station 70. Cavity crush is detected if the distance between two cavities increases. When this occurs, a CAVITY CRUSH fault signal is generated. If the cavity crush measurement is more than ±0.040 inches, the package will be rejected.

Referring again to FIG. 13, three top-down video cameras 435–437 (only camera 437 being visible) are provided for performing top foil inspection, bent corner inspection and web alignment inspection. Top foil inspection is handled by camera 437 (FIG. 5) which is positioned over the centerline of the web following the sealing operation. Inspection occurs during the dwell between web advancement cycles and is triggered by PLC 140. The inspection generates two fault signals: PRINT MISSING, if the bar code print is missing, and BAR CODE OUTSIDE OF SCRAP AREA, if the bar code Q is not properly located in the scrap area. A TRIGGER NAK fault is also generated when the inspection is not performed. If either the PRINT MISSING or BAR CODE OUTSIDE OF SCRAP AREA signal is generated, the corresponding frame of packages will be rejected.

Camera 435 and camera 436 conduct the bent corner inspection. This inspection checks all four corners of the top foil for a bent corner. The inspection is also done during the dwell and is triggered by the PLC 140. A bent corner will generate either a BENTPK1 or BENTPK2 signal and the PLC 140 will cause the corresponding frame to be rejected. A BENTPK1 fault signal indicates that the top foil is too far downstream, while BENTPK2 fault signal indicates that the top foil is too far upstream.

Figure 14:
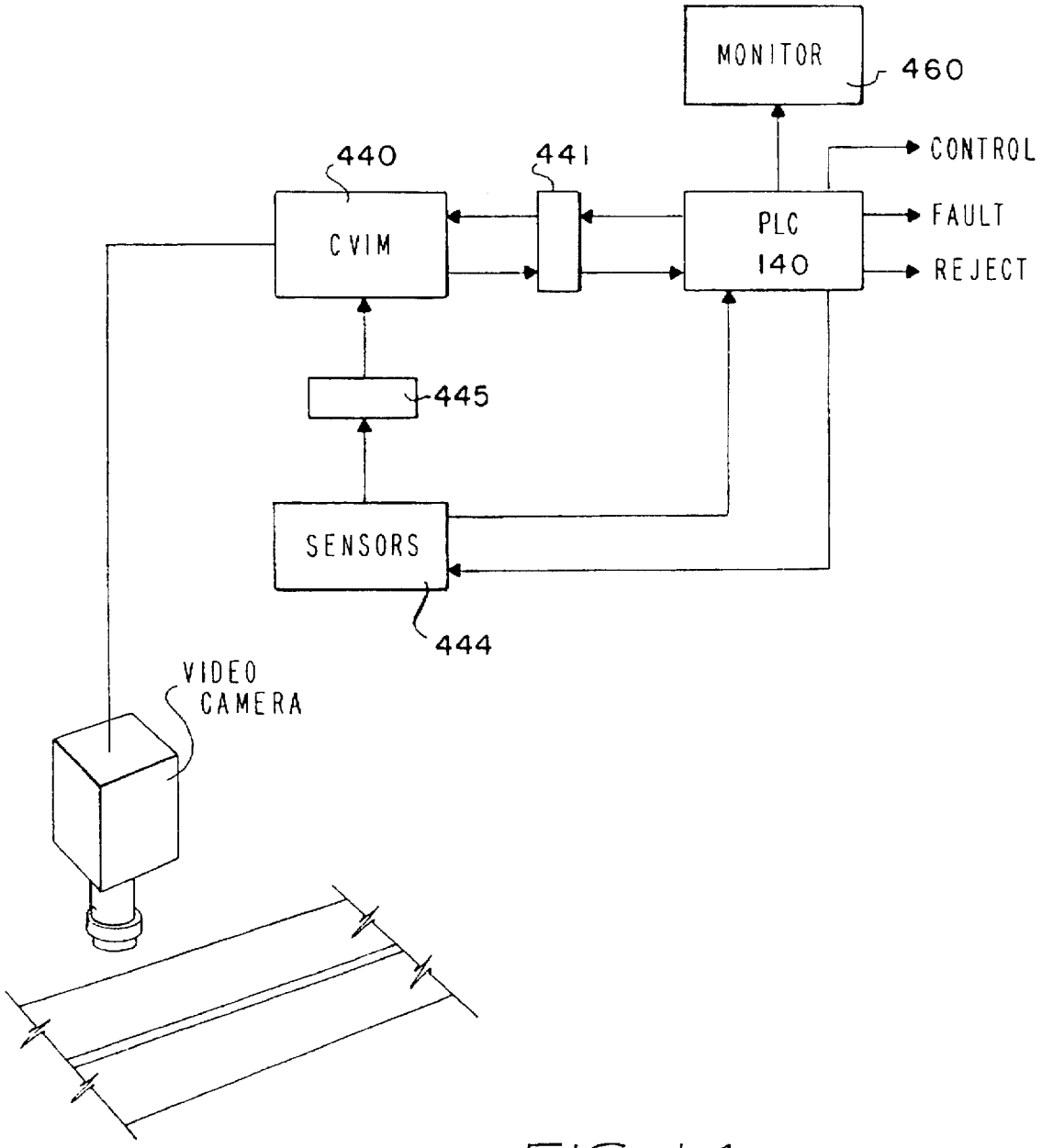
FIG. 14 is a block diagram of the control system associated with the vision system of the present invention.

FIG. 14 is a functional block diagram of vision system which depicts one video camera of the set of video cameras 430–437, connected to optical processor 440, which is preferably an Allen Bradley Model 5370 CVIM optical processor. The optical processor 440 communicates with the PLC 140 through an OPTO-22 converter module 441, which adjusts signal voltage levels in a well known manner. Fiber optic sensors 444, each of which comprises a fiber optic light source and photoelectric cell, communicate signals indicative of product position to the PLC 140. A sensor 444 also communicates timing signals to the optical processor 440 via OPTO-22 converter module 445.

A sensor 444 is activated whenever the beam between the light source and the photoelectric cell is interrupted. When a sensor 444 detects the location of a cavity D in the web, a signal is sent to PLC 140 which in turn sends a signal to trigger operation of a corresponding one of the cameras 430–437. When the cavity D breaks the fiber optic beam, a signal is sent to PLC 140, as described above, which sends a trigger pulse to optical processor 440, which activates the appropriate camera. The image is then received by optical processor 440 where it is compared with stored data representing the parameters of the expected image, such parameters being indicative of a "no fault" condition.

Optical processor 440 compares the real time image data and stored parameters by comparing the data on a pixel-by-pixel basis. When the real time pixel data fails to match the expected parameters within an acceptable range of variation, a fault condition is detected by the optical processor 440 and the results sent to the PLC 140. PLC 140 then acts in accordance with its programmed instructions to electronically "tag" product for downstream rejection, display a warning signal to the operator, halt the process, or display an image to the operator on vision system monitor 460 (FIG. 15) and wait to receive information input from the operator to adjust process conditions.

Figure 15:
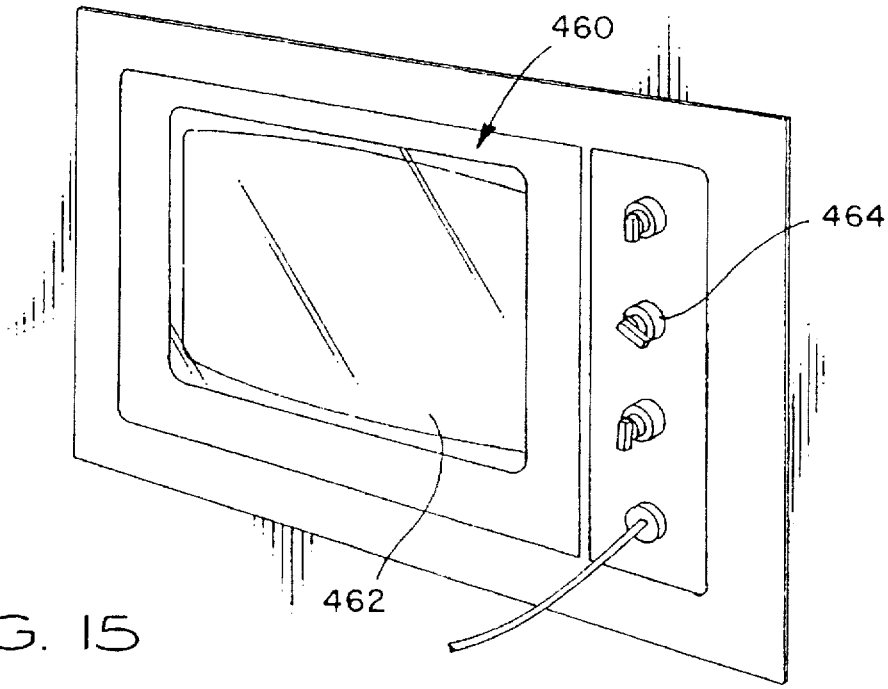
FIG. 15 is a perspective view of the vision system monitor at the operator's station.

FIG. 15 illustrates the vision system monitor 460 located at the operator interface 62. Monitor 460 contains a CRT screen 462 with conventional controls 464 that permit the operator to view certain images seen by the cameras or stored by optical processor 440. For example, the vision system monitor may display images of a package with reference lines indicative of the proper position for hole registration or images showing the spacing between adjacent cavities. By viewing these images on the screen, the operator can make appropriate time, temperature and speed adjustments to the processes by entering information to the PLC 140 using controls at the operator interface 62.

Figure 16:
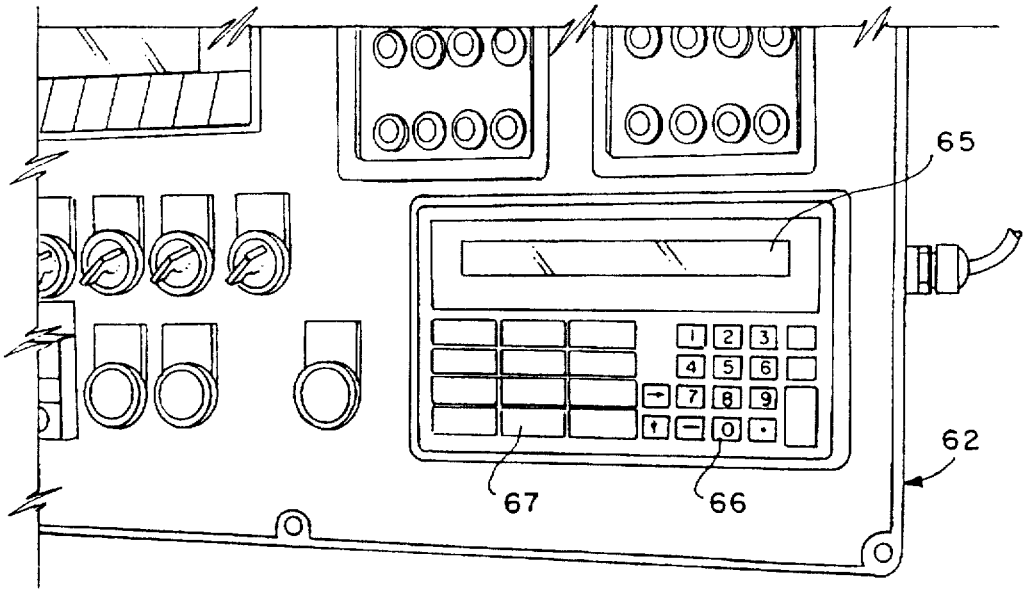
FIG. 16 is a perspective view of the operator interface of the packaging machine of the present invention.

FIG. 16 illustrates the operator interface 62 for PLC 140. The interface 62 for PLC 140 comprises an LED display 65, a keypad 66 and a set of function keys 67 for entering information into PLC 140. The operator interface 62 allows the operator to monitor process conditions in response to fault signals received from vision system 400. The operator can also use the interface 62 to adjust parameters, such as times and temperatures, as conditions require.

Servomotor Drive System

As the web of foil stock travels through the packaging machine, an improved servo drive system controls advancement of the web. This new system, illustrated in detail in FIGS. 17 and 18, replaces the cam-driven web advancement system described above in connection with FIGS. 2 and 3 with a servo drive system 500, which includes a reciprocating carriage 510 for clamping the web 11 and pulling it down line. The carriage 510 is slidably mounted on a frame 533, which also supports a servo motor assembly 540 and associated servomotor 542.

The servo drive system 500 permits more precise control of speed and acceleration in both the advancing and return strokes of the carriage 510, resulting in reduced acceleration of product as it is advanced, which, in turn, minimizes the amount of product shift during advancement and thus minimizes possible sealing defects associated therewith. At the same time, the system permits the speed of the return stroke to be increased, reducing overall cycle time and increasing machine processing speed.

Figure 17:
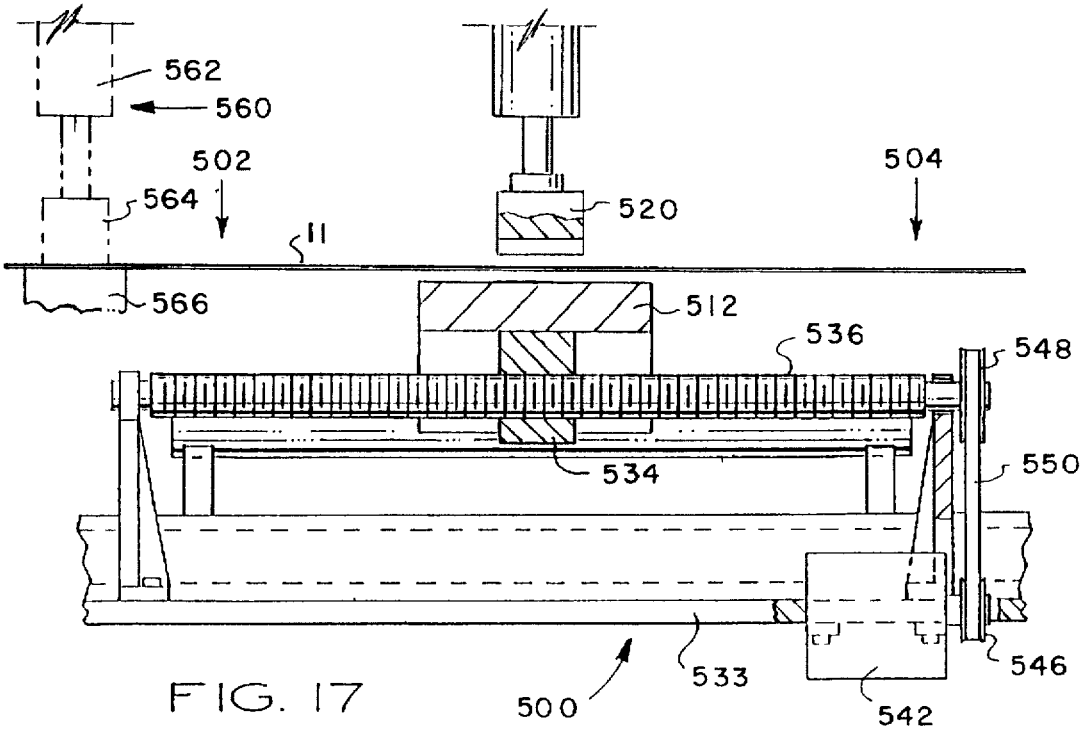
FIG. 17 is a schematic side view of the servo drive web advancement system of the present invention.
Figure 18:
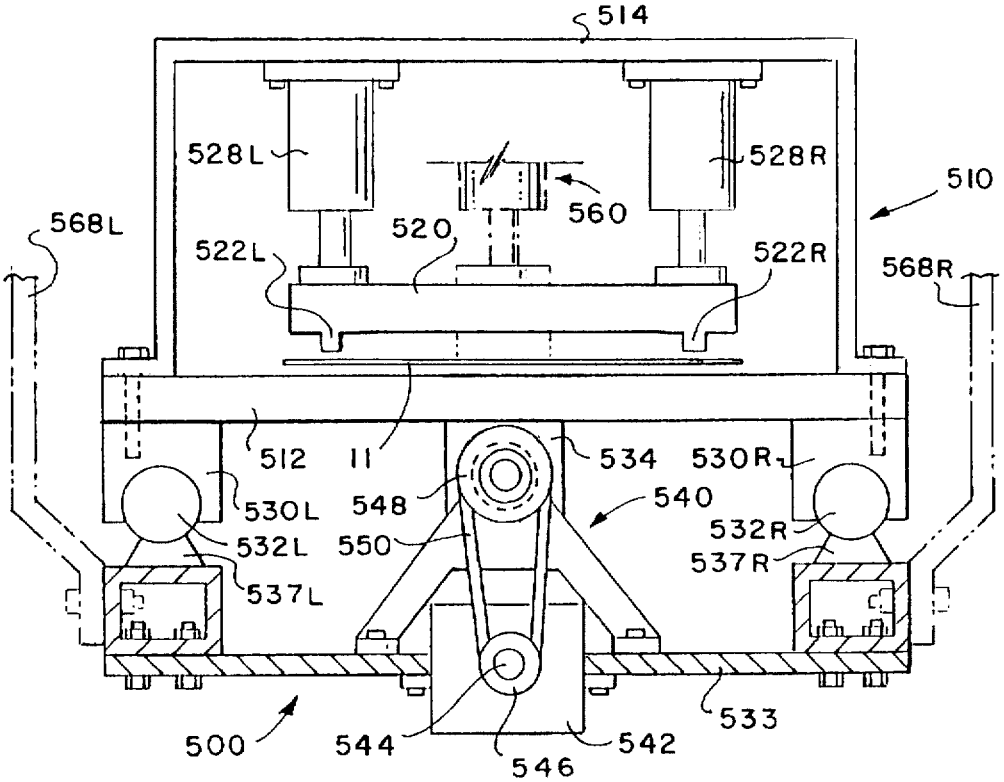
FIG. 18 is a schematic end view of the servo drive web advancement system of the present invention.

FIGS. 17 and 18 illustrate the servo drive system 500 employed in the modified Höfliger machine 2. The web 11 is fed to servo drive system 500 at station 502 where the web is clamped by the reciprocating carriage 510, which advances the web forward to station 504 (FIG. 17). When the carriage reaches position 504 at the end of the advancing stroke, it releases the web and returns to position 502 under the control of the servomotor assembly 540. Servomotor 542 may be a suitable servomotor, such as AREG Posi D Digital Servo Drive BG 63–100 manufactured by Carlo Gavazzi GmbH.

The carriage 510 includes a table 512 below the web 11 and a clamping bar 520 above the web 11. The bar 520 is suspended from above by pneumatically actuated cylinders 528L and 528R. The cylinders are mounted on the underside of a canopy 514, which in turn is secured to the transverse edges of the table 512 as schematically depicted in FIG. 18. Clamping bar 520 has downwardly extending feet 522L and 522R, which are positioned so as to clamp the web at two points, preferably overlapping the leading and trailing edges of adjacent top foils, which at this stage have already been secured to the web by the primary sealing operation. Contact by the feet is preferably made in the primary seal areas formed between the top foils and the underlying web. Clamping bar 520 is forced downwardly against the top foils during the advancement stroke by pneumatically actuated cylinders 528L and 528R under the control of PLC 140 so as to clamp the web (with attached top foils) to the table 512. The clamping action occurs with the carriage 510 at position 502 (FIG. 17). The carriage then pulls the web forward to position 504 in response to the action of the servomotor assembly 540.

As shown in FIG. 18, the carriage 510 rides on a pair of sliders 530L and 530R mounted on the underside of the table 512. The sliders 530L and 530R reciprocally slide on a pair of guide rails 532L and 532R that are mounted on the machine frame 533 by means of supports 537L and 537R. Guide rails 532L and 532R permit reciprocating movement of carriage 510 in the advancing and retracting directions while accurately maintaining the transverse alignment of the web.

A socket 534 engages the underside of the table 512 and is adapted to receive and engage the grooves of a ball lead screw 536 to permit reciprocation of the entire carriage 510 from point 502 to point 504 and back as ball lead screw is rotated first in one direction then the other. Ball lead screw 536 is actuated by the servomotor assembly 540, which is mounted on the machine frame 533. The assembly 540 includes the servomotor 542, a pair of pulleys 546 and 548 and a timing belt 550. The servomotor 542 has a shaft 544 connected to pulley 546. One end of ball lead screw 536 is mechanically connected to pulley 548 which is rotatably mounted adjacent location 504.

Servomotor 542 is energized under the control of the PLC 140, which causes rotational movement of ball lead screw 536 in a direction causing carriage 510 to advance from point 502 to point 504. When carriage 510 pulls the web to location 504, the air cylinders 528L and 528R are retracted, the polarity of the voltage is reversed and the servomotor, under the direction of the PLC 140, causes the carriage 510 to return back to position 502 where the cycle is completed.

When the web 11 is not being advanced by the carriage 510, it preferably is held in place to prevent dislocation of the web when the machine 2 is idle for any reason. The web 11 is also preferably held in place between advancement cycles to maintain optimum transverse alignment and longitudinal registration. The web is preferably held in place during idle time and between advancement cycles by a clamping assembly 560, shown partially in phantom in FIGS. 17 and 18. The clamping assembly 560 has a pneumatically operated cylinder 562, which selectively extends and retracts a foot 564 to alternatively clamp and release the web 11 between the foot 564 and a base 566. The clamping assembly 560 and base 566 are secured to the frame 533 in a suitable manner, such as by side frame extensions 568L and 568R (FIG. 18).

Under the control of servomotor 542, the speed and rotation of the ball lead screw 536 can be precisely controlled, minimizing acceleration of the web as it is advanced from point 502 to point 504, while simultaneously increasing the speed of the return cycle. This not only speeds up the processing cycle, but eliminates undesirable acceleration of the product, thus minimizing displacement of the packets within the cavities. For example, the prior art cam-driven web advancement system can optimally operate at about 17 cycles per minute and experience rejection rates as high as 25 percent. In the modified Höfliger machine 2 incorporating the present invention, processing speed can be increased to 22 cycles per minute with a reduction in rejection rates to a much lower average level in which the peak rejection rate experienced is about 15 percent.

It will be understood that various modifications can be made to the embodiments of the present invention herein disclosed without departing from the spirit and scope thereof. Therefore, the above description should not be construed as limiting the invention, but merely as examples of preferred embodiments thereof. Those skilled in the art will envision other modifications within the scope and spirit of the present invention as defined by the appended claims.

We claim:

1. For use with a machine for making sealed sterile suture packages in which a web of foil stock is fed from a roll into the leading edge of the machine to be processed, apparatus for sequentially advancing the web in the machine, comprising:

a reciprocating carriage capable of reciprocal movement in the direction of travel of the web between the upstream and downstream ends of the apparatus;

gripping means mounted on said carriage for releasably gripping the web;

a pair of guide rails for slidably supporting said carriage and maintaining alignment of said carriage and the web;

a screw shaft adapted to engage said carriage, said screw shaft causing said carriage to advance from the upstream to the downstream end of the apparatus in response to rotation of said shaft in a first direction and causing said carriage to retract from the downstream to the upstream end of the apparatus in response to rotation of said shaft in a second direction;

a servomotor being connected to said screw shaft;

a power source for selectively energizing said servomotor; and control means connected to said power source and said gripping means for controlling said gripping means to selectively grip and release the web and for controlling the application and polarity of voltage to said servomotor.

2. The apparatus of claim 1 wherein said gripping means includes a releasable clamp and pneumatically actuated cylinder for selectively actuating and releasing said clamp in response to said control means.

3. The apparatus of claim 1 wherein said servomotor and said screw shaft are each connected to a pulley and said pulleys are connected by a timing belt.

4. The apparatus of claim 1 wherein said control means includes a programmable logic controller.

5. For use with a machine for making sealed sterile suture packages in which a web of foil stock is fed from a roll into the leading edge of the machine to be processed, apparatus for sequentially advancing the web in the machine, comprising:

a moveable carriage capable of reciprocal movement in the direction of travel of the web between the upstream and downstream end of the apparatus;

a pair of guide rails for slidably supporting said carriage as it moves between the upstream and downstream ends of the apparatus;

a clamp mounted on said moveable carriage for releasably gripping the web;

an hydraulically actuated cylinder mechanically connected to said clamp for selectively releasing and engaging said clamp;

a screw shaft adapted to engage said carriage and causing said carriage to advance from the upstream to the downstream end of the apparatus in response to rotation of said shaft in a first direction and causing said carriage to retract from the downstream to the upstream end of the apparatus in response to rotation of said shaft in a second direction;

a servomotor connected to said screw shaft;

a power source; and a programmable logic controller connected to said hydraulically actuated cylinder and to said servomotor for controlling the release and engagement of the web by the clamp and for controlling the application and polarity of voltage from said power source to said servomotor.

* * * * *

UNITED STATES PATENT AND TRADEMARK OFFICE

CERTIFICATE OF CORRECTION

PATENT NO. : 5,732,529

DATED : March 31, 1998

INVENTOR(S) : Clifford A. Dey, Robert J. Cerwin, Mark Findlay, Konstantin K. Ivanov, Robert Numez, Donald Pompei, William R. Reinhardt, Mehmet Reyhan, David A. Szabo It is certified that error appears in the above-indentified patent and that said Letters Patent is hereby corrected as shown below:

Cover Sheet: 73 Assignee:

Should read: Ethicon, Inc. Somerville, N.J.

Town now reads: Summerville

Signed and Sealed this

Twenty-seventh Day of October, 1998

*Attest:*

Bruce Lehman

BRUCE LEHMAN

*Attesting Officer*

*Commissioner of Patents and Trademarks*